US005518422A

United States Patent [19]

Zell et al.

[11] Patent Number: 5,518,422

[45] Date of Patent: May 21, 1996

[54] PLUG-TYPE CONNECTOR FOR BACKPLANE WIRINGS

[75] Inventors: Karl Zell, Niederpoecking; Peter Seidel, Groebenzell; Rudolf Goerlich, Bad Friedrichshall, all of Germany

[73] Assignee: Siemens Aktiengesellschaft, Munich, Germany

[21] Appl. No.: 397,612

[22] Filed: Mar. 2, 1995

[30] Foreign Application Priority Data

Mar. 3, 1994 [EP] European Pat. Off. ..... 94103192

[51] Int. Cl.[6] ..... H01R 13/648

[52] U.S. Cl. ..... 439/608; 439/79

[58] Field of Search ..... 439/79, 80, 95–98, 439/108, 607, 608, 609

[56] References Cited

U.S. PATENT DOCUMENTS 5,354,219 10/1994 Wanjura ..... 439/608

5,415,566 5/1995 Brunker et al. ..... 439/608

FOREIGN PATENT DOCUMENTS 4313771 11/1994 Germany .

*Primary Examiner*—Kheim Nguyen

*Attorney, Agent, or Firm*—Hill, Steadman & Simpson

[57] ABSTRACT

A plug-type connector is provided having shield elements that surround signal-carrying conductor parts. Shielding plates are placed in slots in walls of receptacle chambers which house a spring contact strip. Shield elements are disposed in slots in a wall or floor of the blade connector. The shielding plates of the spring contact strip (8) include transverse shielding plates (14) and longitudinal shielding plates (13) fashioned comb-like so that they interfit and interconnect. The shielding plates (13, 14) are provided with incisions of a predetermined width at a front region of the receptacle chambers (11), having the respective corners bent off in a predetermined direction. Thin, additional contact pins (3) are anchored in the blade connector (1) and are connected to ground. These pins (3) are provided at the intersections of the shield elements and contact the shielding plates (13, 14) of the spring contact strip (8) at four points in the front region of the receptacle chambers (11).

10 Claims, 5 Drawing Sheets

PLUG-TYPE CONNECTOR FOR BACKPLANE WIRINGS

BACKGROUND OF THE INVENTION

The present invention is generally directed to a plug-type connector for backplane wirings. More specifically, the present invention relates to a plug-type connector having a blade connector fashioned as a rectilinear housing open at one side for the purpose of plugging onto blades of a wiring backplane and of a spring contact strip that is firmly joined to a module pc board, is provided with receptacle chambers and can be plugged into the blade connector, whereby the blades and springs are arranged parallel in a plurality of rows, whereby the walls of the receptacle chambers are provided with slots that surround the receptacle chambers and into which electrically conductive shield elements are inserted, these being conductively connected to one another to form a potential cage, and whereby the floor of the blade connector is provided with slots that surround the blades and into which electrically conductive shield elements are placed.

German Patent Application 4,313,771 relates to a shielding plug-type connector. That plug-type connector exhibits high-frequency properties at high transmission frequencies when compared to conventional plug-type connectors. However, those improved high-frequency properties do not satisfy all demands.

SUMMARY OF THE INVENTION

An object of the present invention is to provide a plug-type connector of the species described having improved high-frequency properties to satisfy all present demands.

This object is achieved by providing a connector having matable first and second portions, each of which has interconnecting shield elements which generally enclose signal-carrying conductor elements, providing a shielding effect not unlike that achieved in conventional coaxial arrangements. The shield elements of the first and second connector portions interconnect when plugged together and are grounded. The first and second connector portions can be configured specifically such that the first portion is connectable to a wiring backplane and such that the second portion securably inserts onto a printed circuit board.

To this end, in an embodiment, a plug-type connector is provided having a blade connector portion and a spring contact portion which are connectably matable. The blade connector has a rectilinear housing which is connectable with a wiring backplane. The blade connector portion has at least one row of contact blades and wall with slots generally surrounding the respective blades. Electrically conductive shield elements are disposed within the slots to generally surround the contact blades. The spring contact portion has a plurality of conductors, each conductor having a spring contact to receive one of said blades. The spring contacts are arranged in at least one row. Opposite ends of the conductors are securably connectable to a printed circuit board. The spring contact portion has a plurality of receptacle chambers within which the spring contacts are respectively disposed to receive the contact blades. A plurality of conductive transverse shielding plates and conductive longitudinal shielding plates are provided in the spring contact portion. The plates are slotted and interconnectably arranged in an intermeshing comb-like manner within slots in the spring contact portion, forming a shielding potential or Faraday cage generally enclosing each conductor. A plurality of incisions of predetermined width are provided in the plates adjacent the receptacle chambers. These incisions have angled edges bent in a predetermined direction. A plurality of grounded contact pins are secured in the blade connector portion at intersecting points of the shield elements so that, in a mated condition, the contact pins are inserted into the incisions, contacting the shielding plates of the second portion at four places in the front region of the receptacle chambers.

In an embodiment, the shield elements of the blade connector are a plurality of sheet metal shielding strips cooperatively shaped in a comb-like manner to be connectably interlaced with each other. Also, the shielding strips are generally wave-shaped to resiliently contact the contact pins at intersecting points of the shielding strips. An extremely good shielding of the signal-carrying blades is also achieved within the blade connector floor in this way.

In an embodiment, in order to also provide a right-angle configuration plug-type connector with good high-frequency properties each conductor of the spring contact portion is generally L-shaped, or shaped at a right angle. Accordingly, each longitudinal shielding plate is L-shaped at a right angle. Each L-shaped shielding plate has a first leg oriented parallel to a longitudinal direction of the receptacle chambers and a second leg oriented perpendicularly to the printed circuit board. The longitudinal shielding plates are separated from one another in the respective right angle regions by insulative angle profile elements.

In an embodiment, at least one tab extends from each transverse shielding plate. A plurality of oblong holes are provided in the second leg of an outermost longitudinal shielding plate to respectively receive one of tabs.

In an embodiment, at least one press-in pin extends from at least one of the longitudinal shielding plates to contact the printed circuit board. A coaxial shielding thereby results, this being less expensive compared to the traditional coax plug-type connector embodiment and lending the plug-type connector of the invention high-frequency properties that meet all current demands.

Other objects, features and advantages of the present invention will be readily apparent from the following description of the presently preferred embodiments thereof taken in conjunction and with the accompanying drawings although variations and modifications may be effected without departing from the spirit and scope of the novel concepts of the disclosure.

DETAILED DESCRIPTION OF THE PRESENTLY PREFERRED EMBODIMENTS

Figure 1B:
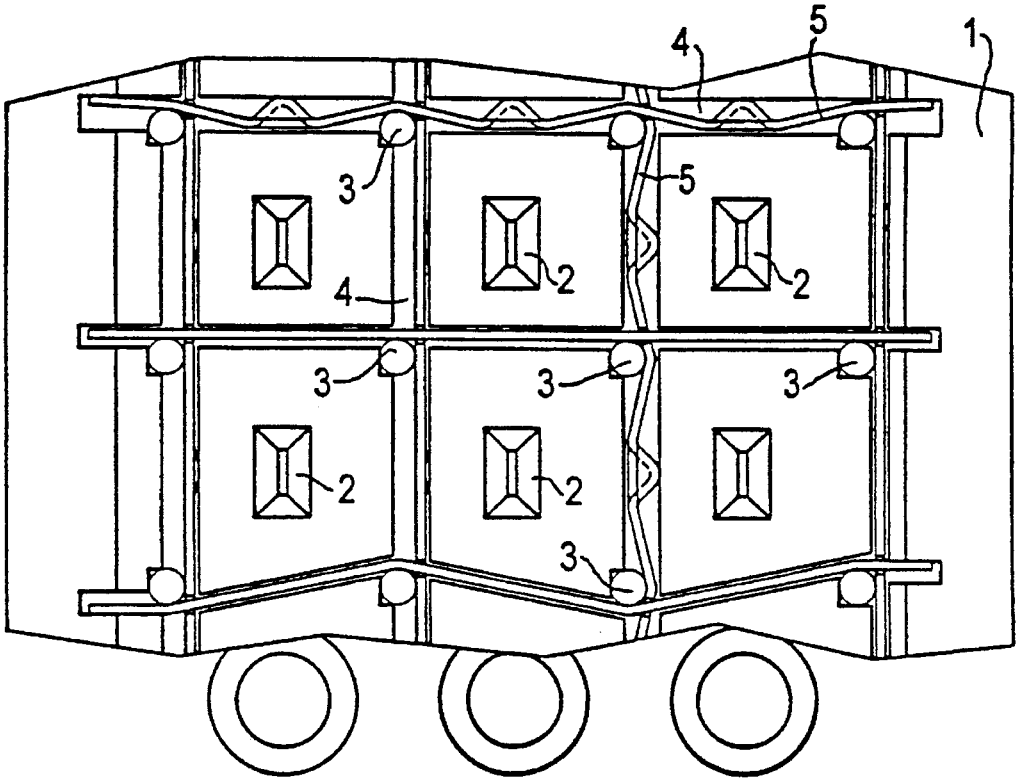
FIG. 1B illustrates a partial plan view onto a blade connector plugged onto the wiring backplane.
Figure 1A:
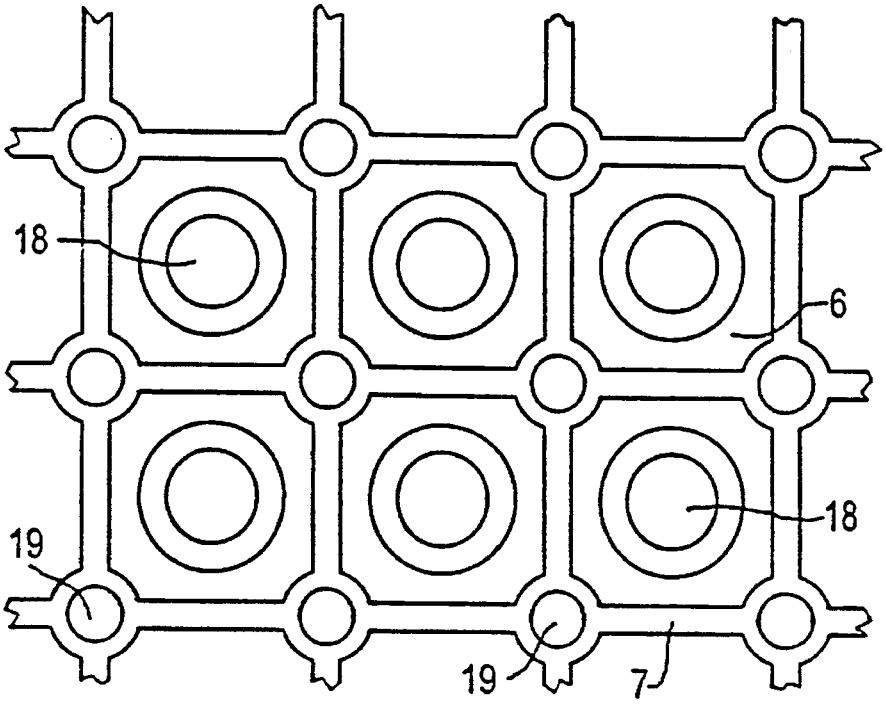
FIG. 1A illustrates a partial plan view onto a wiring backplane.

FIG. 1A shows a partial plan view onto a potential plane of the wiring backplane 6 having the larger bores 18 for receiving contact blades and the smaller bores 19 for receiving contact pins 3 associated with shielding. FIG. 1B shows a partial plan view onto a blade connector housing 1 that has been plugged onto the wiring backplane 6. Slots 4 are provided in a wall of the blade connector housing 1 between contact blades. Shielding elements, or more particularly, resilient sheet metal shielding strips 5 are disposed in these slots 4.

As shown in FIG. 1B, the sheet metal shielding strips 5 can be fashioned comb-like so that perpendicular strips 5 can be pushed into one another in an interlaced, interfitting grid-like manner. The strips 5 can also be flat. In the embodiment illustrated, the sheet metal shielding strips 5 can be shaped in a wave-like or corrugated manner so that they resiliently press non-positively against contact pins 3 for reliable contacting. The contact pins 3 are held in a plastic body of the blade connector and are conductively connected to one another via the sheet metal chambers formed by the sheet metal shielding strips 5. Preferably, the plastic body is comprises a wall which is at least 1 mm thick.

Figure 2A:
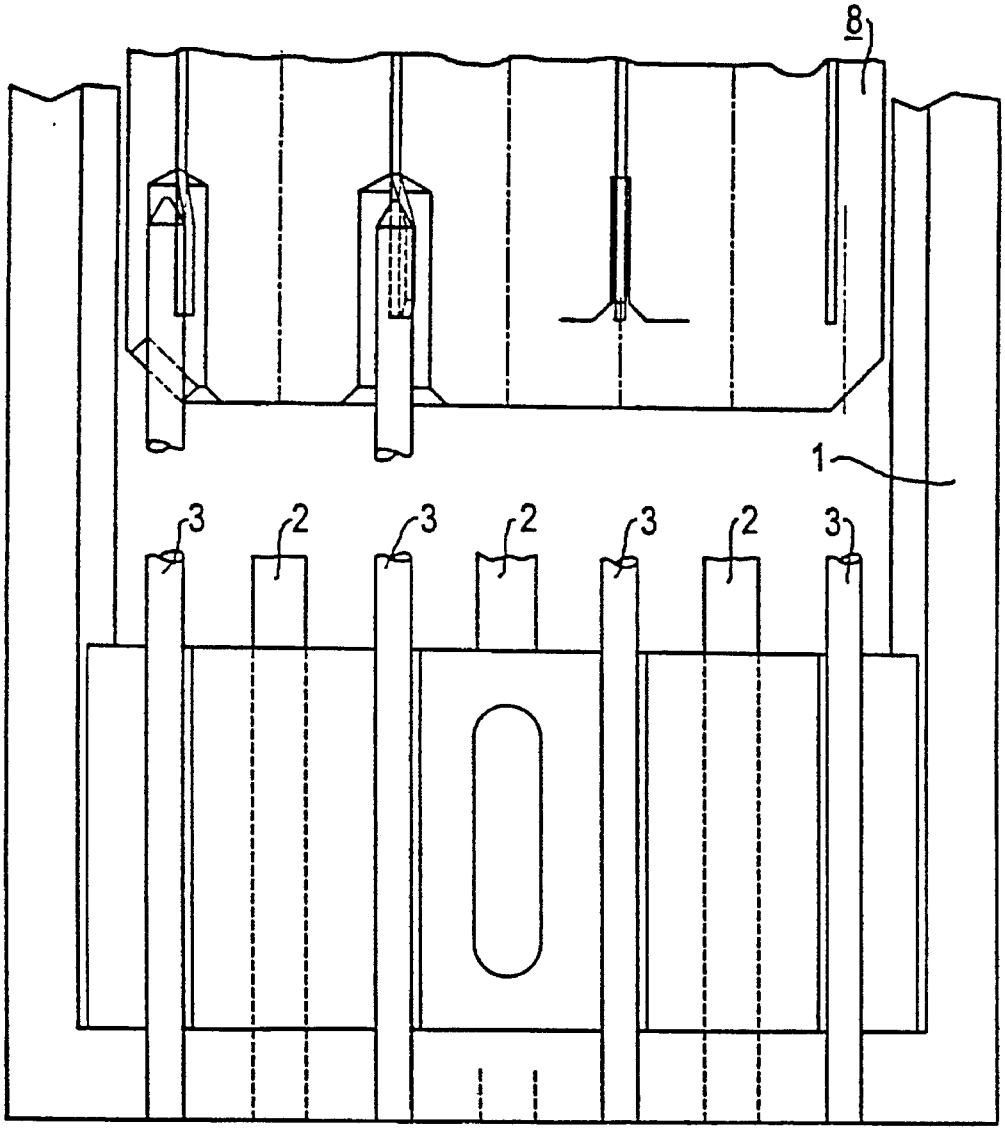
FIG. 2A illustrates a partial cross-section through the blade connector.
Figure 2B:
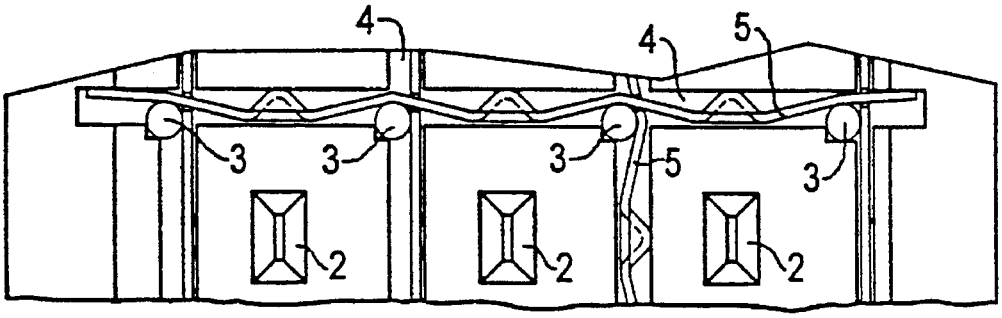
FIG. 2B illustrates a partial cross-section through the spring contact strip and the blade connector.

FIG. 2A shows a partial section through the blade connector housing 1 and FIG. 2B illustrates a partial plan view of the blade connector housing 1. FIG. 2A also illustrates relationship of the first portion or the blade connector 1 to a second portion of the connector of the present invention, a spring contact strip housing 8. The blade connector 1 and spring contact strip housing 8 are matably insertable together, into as shown in FIGS. 2A and 2B .

Figure 3:
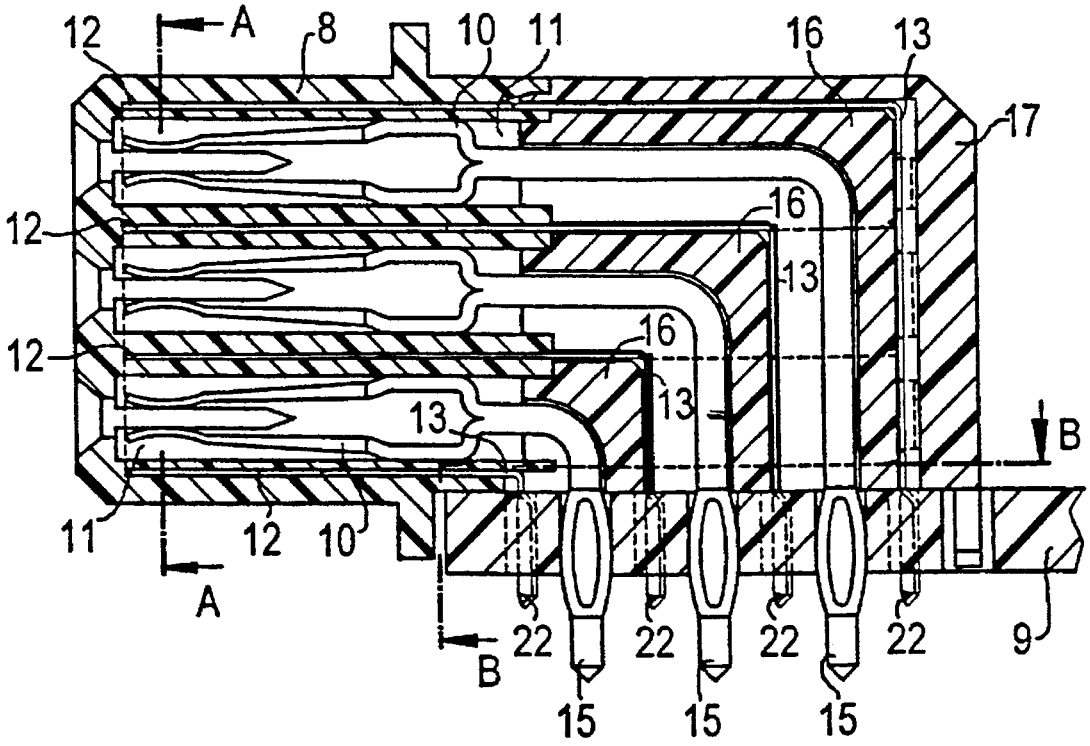
FIG. 3 illustrates a cross-section through a spring contact strip, whereby the terminals are bent off at a right angle.
Figure 4:
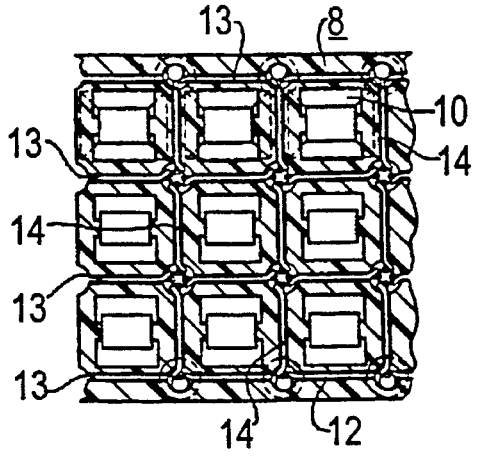
FIG. 4 illustrates a partial cross-section through a spring contact strip taken generally along line A—A of FIG. 3.
Figure 5:
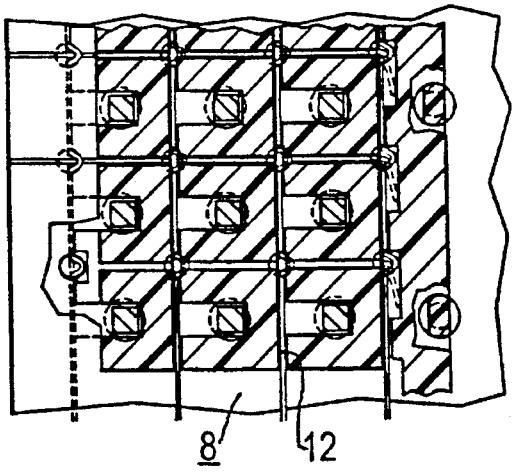
FIG. 5 illustrates a partial cross-section through a spring contact strip taken generally along line B—B of FIG. 3.

The structure of the spring contact strip housing 8 is illustrated in FIGS. 3, 4, and 5. As shown in FIG. 3, the spring contact strip housing 8 has conductors or terminals which are angled or directed toward the printed circuit board at a right angle. Each conductor has a first end with a contact spring 10 and a second end with a printed circuit board contact leg or press-in pin 15. Receptacle chambers 11 are provided in the spring contact strip housing in which the contact springs 10 reside. The contact springs 10 are thereby conductively joined to the press-in pins 15 which are configured to securely plug into receiving holes in the module pc board 9.

Figure 7:
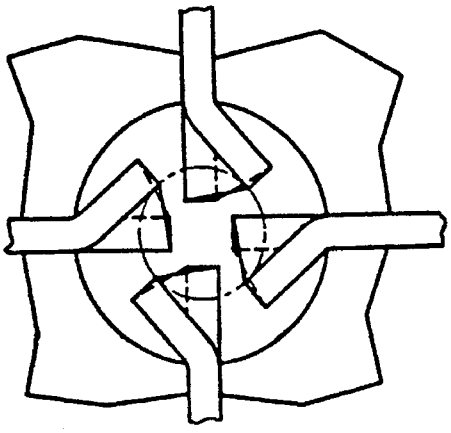
FIG. 7 illustrates a detail when the contact pin is plugged into the spring contact strip.

Longitudinal shielding plates 13 and transverse shielding plates 14 are arranged in slots 12 between the receptacle chambers 11 inside the spring contact strip housing 8. These shielding plates 13 and 14 are cooperatively shaped, being fashioned generally comb-like. Also, the shielding plates 13, 14 having incisions formed therein of a predetermined width adjacent to a front region (facing the blade connector 1), of the receptacle chambers. The respective corners of the incisions are bent off into a predetermined direction, as shown in detail in FIG. 7.

Figure 6:
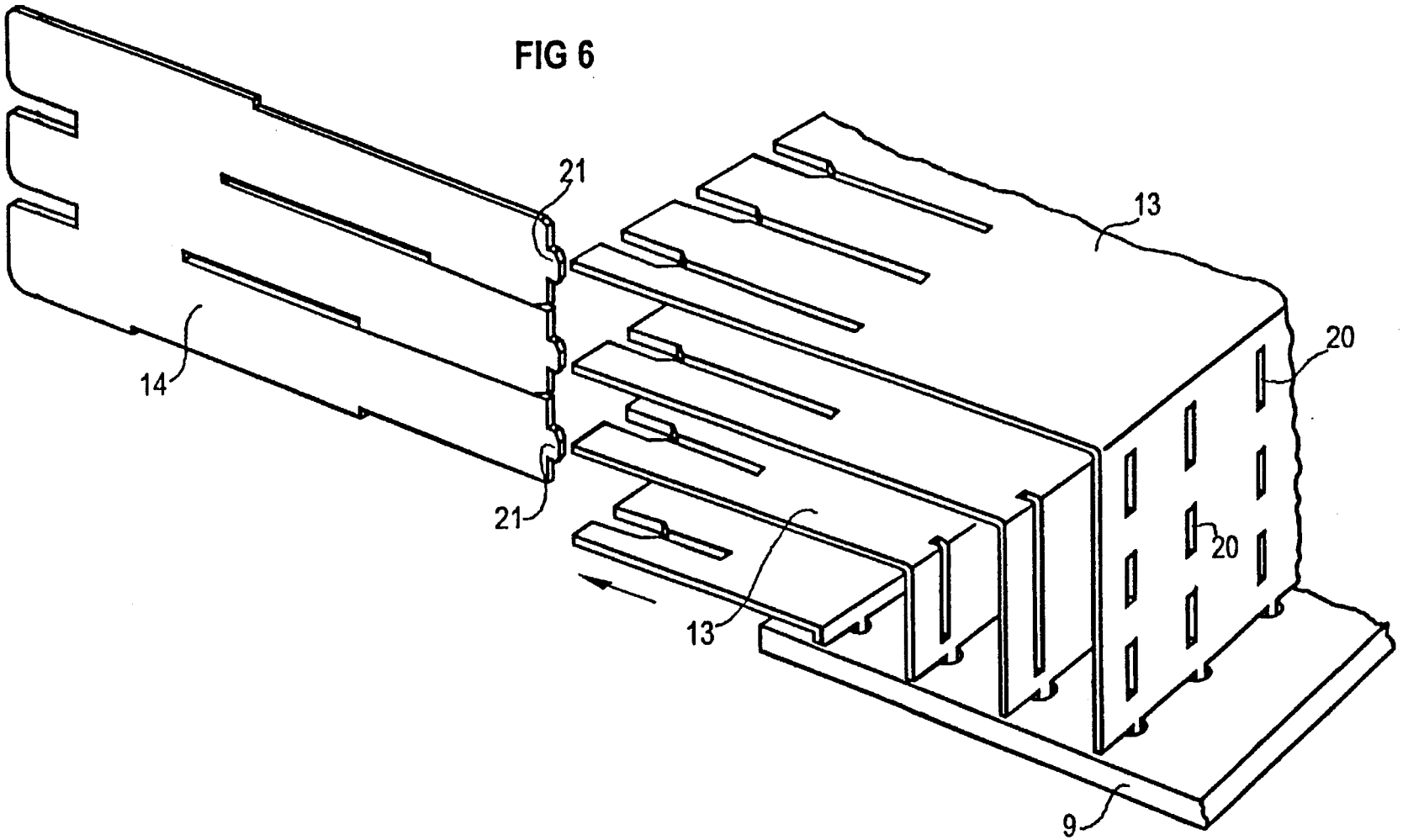
FIG. 6 illustrates a perspective, exploded view of a transverse shielding plate and of a plurality of angled longitudinal shielding plates.

The structure and the arrangement of the longitudinal shielding plates 13 and of the transverse shielding plates 14 is illustrated in FIG. 6. FIG. 6 shows an embodiment wherein the longitudinal shielding plates 13 are generally L-shape or angled-off, however, the longitudinal shielding plates 13 could also be straight in an embodiment wherein the spring contact strip housing 8 is a straight passage (not shown). In the embodiment of FIG. 6, each longitudinal shielding plate 13 has a first leg parallel to the contact springs and a second leg residing perpendicularly to the module printed circuit board. The endmost second leg includes oblong holes 20 through which tabs 21 of the shielding plates 14 (only one plate 14 is shown in FIG. 6) project in order to assure a good contact between the shielding plates 13, 14. Each tab 21 is bent over after being inserted through its respective hole 20.

As also shown in FIG. 6, the respective second legs of the middle longitudinal shielding plates are slotted to cooperatively provide passage of the transverse shielding plates therethrough. Furthermore, as illustrated in FIGS. 6 and 3, a plurality of ground press-in pins 22 extend from each longitudinal shielding plate. The ground press-in pins 22 are arranged parallel to the PCB contact legs or press-in pins 15 for connectable insertion onto the printed circuit board 9.

The longitudinal shielding plates 13 are insulated from one another and from the conductors by insulating angle profiles 16 which follow the shape of each shielding plate 13. The entire angle region is covered with an insulative cover angle 17 that is held with latched connections. The longitudinal shielding plates 13 have press-in pins 22 extending therefrom to contact and plug into the module pc board 9.

It should be understood that various changes and modifications to the embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

What is claimed is:

1. A plug-type connector comprising:

a blade connector portion having a rectilinear housing connectable with a wiring backplane, at least one row of contact blades, a wall with slots generally surrounding the respective blades, and electrically conductive shield elements disposed within the slots to generally surround the contact blades;

a spring contact portion matable with the blade connector portion, the spring contact portion having a plurality of conductors, each said conductor having a spring contacts to receive one of said blades, the spring contacts being arranged in at least one row, each conductor having an end opposite the spring contact which is securably connectable to a printed circuit board, and a plurality of receptacle chambers within which the spring contacts are respectively disposed to receive the contact blades;

a plurality of conductive transverse shielding plates and conductive longitudinal shielding plates, said plates being slotted and interconnectably arranged in an intermeshing comb-like manner within slots in the spring contact portion, forming a shielding cage generally enclosing each conductor, a plurality of incisions of predetermined width being provided in the plates adjacent the receptacle chambers, the incisions being having angled edges bent in a predetermined direction; and a plurality of grounded contact pins secured in the blade connector portion at intersecting points of the shield elements so that, in a mated condition, the contact pins contact the shielding plates of the spring contact portion at four places in the front region of the receptacle chambers.

2. The plug-type connector according to claim 1, wherein the shield elements of the blade connector portion comprise:

a plurality of sheet metal shielding strips cooperatively shaped in a comb-like manner to be connectably interlaced with each other, the shielding strips being generally wave-shaped to resiliently contact the contact pins at intersecting points of the shielding strips.

3. The plug-type connector according to claim 1, wherein each conductor of the spring contact portion is shaped at a right angle, and wherein each longitudinal shielding plate is L-shaped at a right angle, a first leg of each longitudinal shielding plate being oriented parallel to a longitudinal direction of the receptacle chambers and a second leg oriented perpendicularly relative to the printed circuit board, the longitudinal shielding plates being separated from one another in respective angle regions by insulative angle profile elements.

4. The plug-type connector according to claim 3, further comprising:

at least one tab extending from each transverse shielding plate; and a plurality of oblong holes in the second leg of an outermost longitudinal shielding plate, each oblong hole respectively receiving one of said tabs.

5. The plug-type connector according to claim 1 further comprising:

at least one press-in pin extending from at least one longitudinal shielding plate to contact the printed circuit board.

6. A connector comprising:

a first portion including:

a plurality of conductors, first ends of said conductors forming at least one row of spring contacts, a second end of each conductor being directed from the respective first end, the second ends forming a plurality of contact legs for contacting a printed circuit board; and a plurality of conductive transverse shield plates and a plurality of conductive longitudinal shielding plates, the transverse shielding plates being parallel to each other and perpendicular to the printed circuit board, the longitudinal shielding plates being parallel to each other and perpendicular to the transverse shielding plates, said transverse shielding plates and longitudinal shielding plates being cooperatively slotted to fit together to define a plurality of channels, each channel generally enclosing one of said conductors, a plurality of incisions of a predetermined width being provided in said shielding plates proximal to said spring contacts, said incisions having angled edges bent in a predetermined direction; and a second portion matable with said first portion, the second portion including:

blade contacts contactable with respective spring contacts of the first portion;

a plurality of conductive shield elements arranged in an intersecting, grid-like fashion to generally enclose the blade contacts;

a plurality of grounded contact pins secured to contact the shield elements at an intersection of two said shield elements, the contact pins extending to engage one of said incisions.

7. The connector according to claim 6 wherein the shield elements are generally wave-shaped, resiliently contacting the contact pins.

8. The connector according to claim 1 wherein each conductor is generally L-shaped, and wherein each longitudinal shielding plate is generally L-shaped, each longitudinal shielding plate comprising:

a first leg parallel to spring contacts, and a second leg parallel to the contact legs, the longitudinal shielding plates being separated from each other and from the conductors by insulating angle profile elements.

9. The connector according to claim 8, further comprising:

at least one tab extending from each transverse shielding plate; and at least one hole associated with each tab, the hole being located in the endmost second leg for engagably receiving the associated tab.

10. The connector according to claim 8, further comprising:

at least one press-in pin extending from each second leg to engage the printed circuit board, the press-in pins being parallel to the contact legs.

* * * * *